US005813279A

United States Patent [19]

Farley

[11] Patent Number: 5,813,279

[45] Date of Patent: Sep. 29, 1998

[54] SYSTEM FOR POSITIONING BORESIGHT CALIBRATION TOOLS

[75] Inventor: William L. Farley, King George, Va.

[73] Assignee: The United States of America as represented by the Secretary of the Navy, Washington, D.C.

[21] Appl. No.: 903,330

[22] Filed: Jul. 29, 1997

[51] Int. Cl.[6] ..... F41G 1/54

[52] U.S. Cl. ..... 73/167; 33/234; 33/235

[58] Field of Search ..... 73/866.5, 167; 356/241, 243, 153; 33/233–235, 286

[56] References Cited

U.S. PATENT DOCUMENTS

| | | | |
|---|---|---|---|
| 2,294,913 | 9/1942 | Kaufman et al. | 33/46 |
| 2,548,861 | 4/1951 | Brown | 33/46 |
| 2,819,527 | 1/1958 | Spurling | 33/46 |
| 3,920,335 | 11/1975 | Seehase | 356/138 |
| 4,534,116 | 8/1985 | Davis | 33/234 |
| 4,773,164 | 9/1988 | Taylor et al. | 33/520 |
| 5,150,527 | 9/1992 | Knoster | 33/234 |
| 5,396,708 | 3/1995 | Whitley | 33/234 |

*Primary Examiner*—Robert Raevis
*Attorney, Agent, or Firm*—James B. Bechtel, Esq.

[57] ABSTRACT

A system useful in boresight calibration of a launch cell is provided. The launch cell has a central longitudinal axis coincident with a central longitudinal axis of a projectile that it would support. The launch cell terminates at either end thereof in a door where each door is provided with a hole through which the projectile can pass. The center of the hole is coincident with the central longitudinal axis of the launch cell. The present invention positions a boresight calibration tool relative to the central longitudinal axis of the launch cell. An open-ended first tube is sized for engagement in the hole. The first tube terminates at a first end thereof in a flange that abuts the door when the first tube is inserted into the hole from one side thereof. An open-ended second tube is sized for engagement in the hole from the other side thereof. The second tube terminates at a first end in a flange that is adjacent the door when the second tube is inserted into the hole. The second tube also includes means for supporting a variety of boresight calibration tools at the first end thereof. The first tube is coupled to the second tube when they are engaged in the hole. Provision is made to adjust the spacing between the flange of the second tube and the door in order to "square up" the system. The system remains square even when boresight calibration tools are interchanged.

13 Claims, 6 Drawing Sheets

FIG. 5A
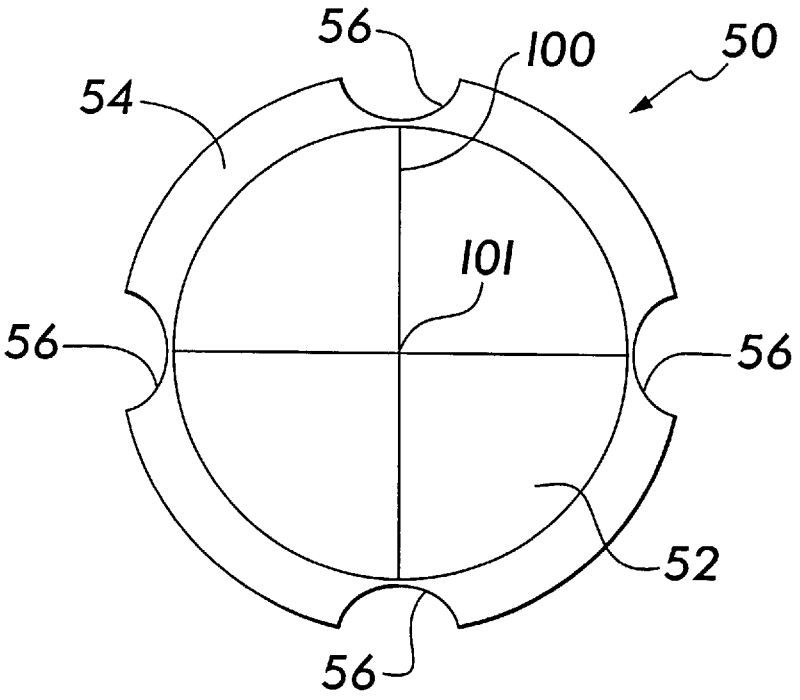
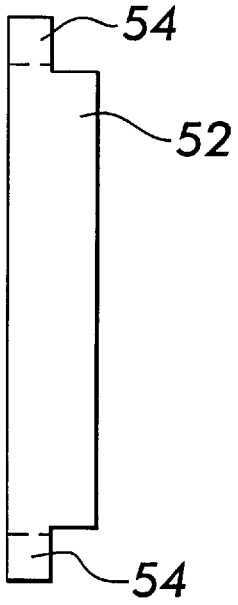
FIG. 5B

SYSTEM FOR POSITIONING BORESIGHT CALIBRATION TOOLS

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to boresight calibration, and more particularly to an adapter system for properly positioning boresight calibration tools at either end of a launch cell.

BACKGROUND OF THE INVENTION

Boresight calibration of missile launch cells is standard operating procedure in the military. Typically, a long boresight dimensioned identically to the missile to be launched measurements can be made. While providing a satisfactory apparatus in terms of making calibration measurements, the size of the apparatus makes its use cumbersome and time-consuming. Therefore, boresight calibration of a missile launch cell is expensive. Obviously, these disadvantages increase if a missile launcher has multiple launch cells. In addition, some launch cells require that calibration measurements be taken at both the forward and aft ends thereof. Thus, the boresight must be removed, turned and then re-installed in the launch cell. Still further, each launch cell of a mobile launcher must be re-calibrated at each new position to obtain line-of-sight elevation and train angles from each launch cell.

SUMMARY OF THE INVENTION

Accordingly, it is an object of the present invention to provide a system for improving boresight calibration of a launch cell.

Another object of the present is to provide a system for positioning standard boresight calibration tools at either end of a launch cell.

Other objects and advantages of the present invention will become more obvious hereinafter in the specification and drawings.

In accordance with the present invention, a system is provided for use with a launch cell. The launch cell is capable of supporting a projectile therein such that a central longitudinal axis of the launch cell is coincident with a central longitudinal axis of the projectile. The launch cell terminates at either end thereof in a door where each door is provided with a hole through which the projectile can pass. The center of the hole is coincident with the central longitudinal axis of the launch cell. The system of the present invention positions a boresight calibration tool relative to the central longitudinal axis of the launch cell. An open-ended first tube is sized for engagement in the hole. The first tube terminates at a first end thereof in a flange that abuts the door when the first tube is inserted into the hole from a side of the door facing towards the launch cell. An open-ended second tube is sized for engagement in the hole. The second tube terminates at a first end thereof in a flange that is adjacent the door when the second tube is inserted into the hole from a side of the door facing away from the launch cell. The first tube and second tube are spaced apart from one another within the hole. The second tube also includes means for supporting a boresight calibration tool at the first end thereof. The first tube is coupled to the second tube when they are engaged in the hole. An adjustment means cooperates between the flange of the second tube and the door for adjusting spacing therebetween.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein:

FIG. 5A is a plan view of a cross-hair supported on a disk-shaped support plate of the present invention;

FIG. 5B is a side view of the disk-shaped support plate; and

DETAILED DESCRIPTION OF THE INVENTION

Figure 1:
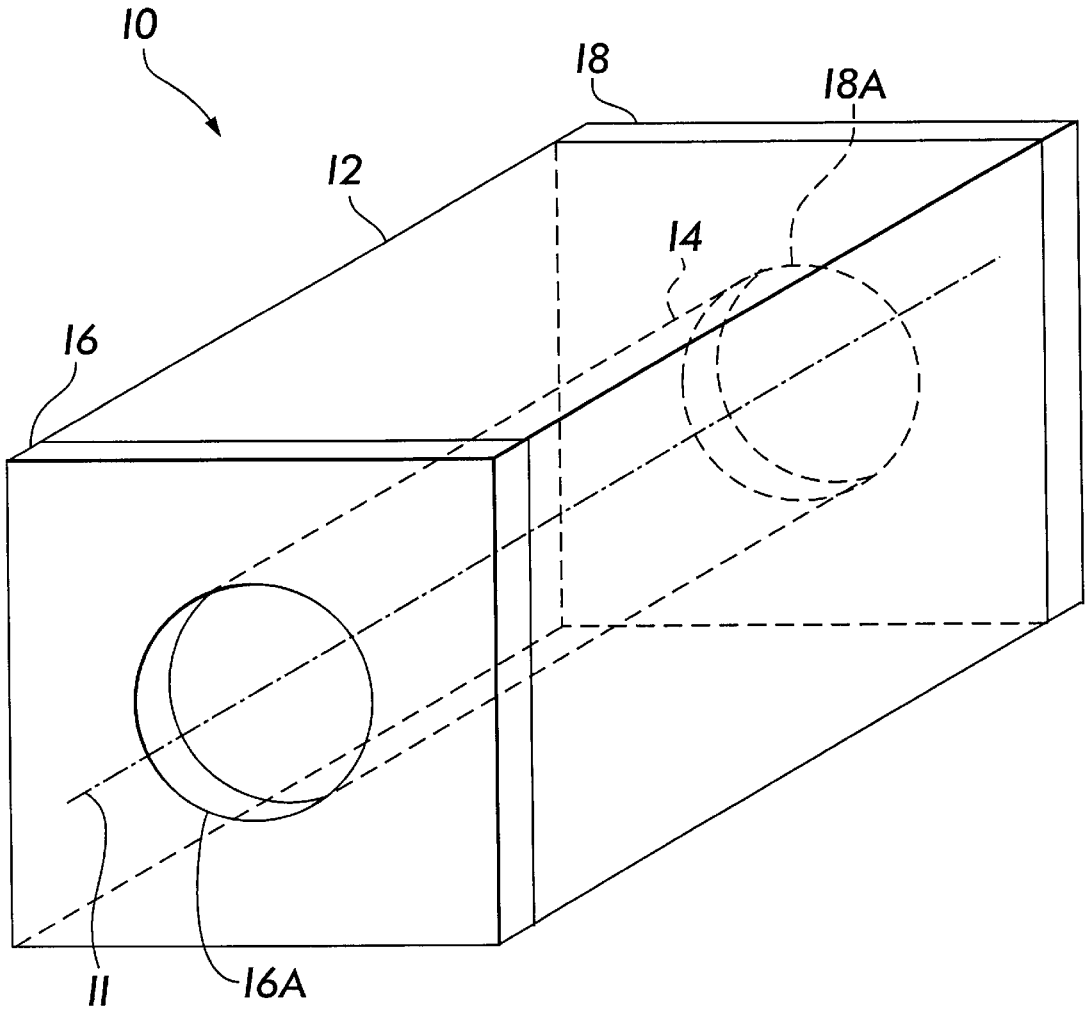
FIG. 1 is a perspective view of a typical missile launch cell having forward and aft doors.

Referring now to the drawings, and more particularly to FIG. 1, a perspective view of a typical missile launcher is shown and referenced generally by numeral 10. Launcher 10 has a housing 12 bored at 14 to define a launch cell that supports a missile (not shown for sake of clarity). Doors 16 and 18 are provided at either end of launch cell 14. Each of doors 16 and 18 are attached to housing 12 in a way known in the art to allow their movement relative to housing 12. Each door is provided with a hole 16A and 18A, respectively. Each of holes 16A and 18A is sized to receive a missile therethrough. Doors 16 and 18 are mounted to housing 12 such that the centers of holes 16A and 18A are coincident with the central longitudinal axis 11 of launch cell 14. Launch cell 14 is designed to support a missile such that the central longitudinal axis of the missile is coincident with launch cell axis 11. An example of a missile launcher with each of its multiple launch cells configured as just described is the U.S. Navy's MK-31 rolling airframe missile launcher.

The present invention provides a system that positions a boresight calibration tool at either the forward or aft end of launch cell 14 depending on the type of calibration measurements needed. By utilizing doors 16 and 18 as well as the above-described relationships between launch cell axis 11 and holes 16A and 18A, the present invention eliminates the need to use the conventional missile-shaped boresight.

Figure 3:
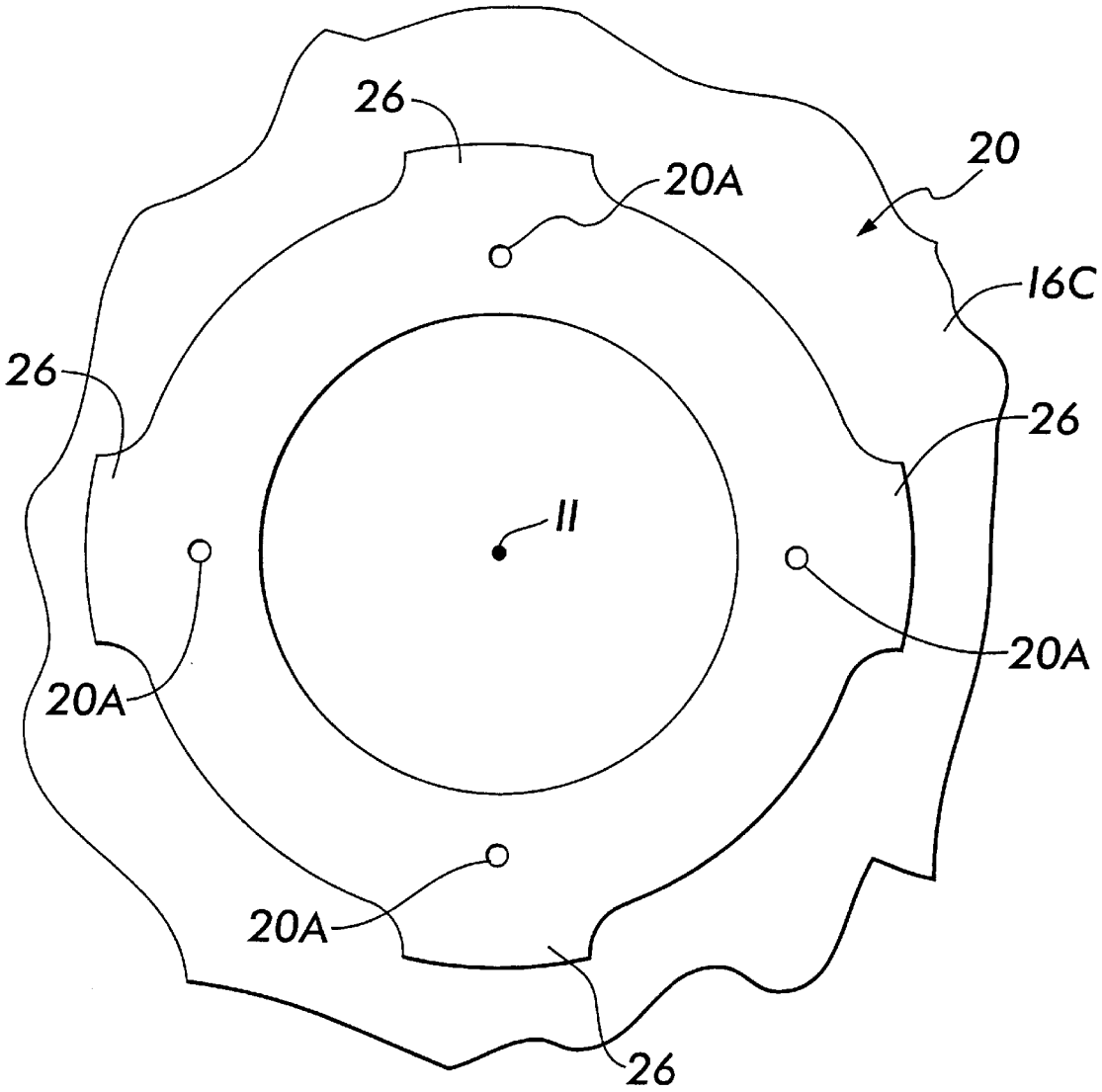
FIG. 3 is a plan view taken along line 3—3 in FIG. 2.
Figure 4:
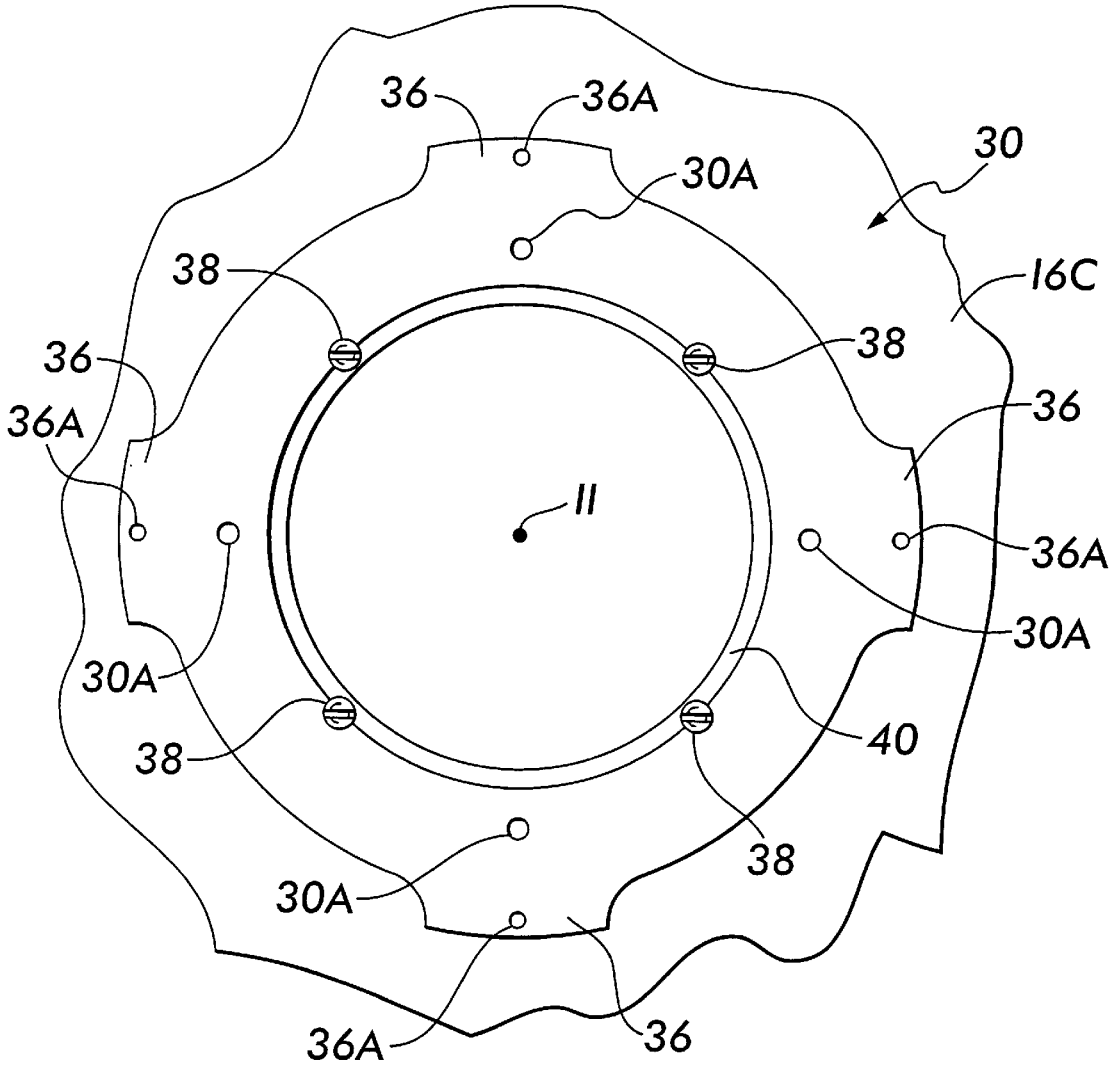
FIG. 4 is a plan view taken along line 4—4 in FIG. 2.

For purpose of description, it is assumed herein that door 16 is located at the forward end of launch cell 14 and door 18 is located at the aft end of launch cell 14 where forward defines the end that a missile's nose will exit at launch. The present invention will first be described for use in (forward) door 16. Simultaneous reference will be made to FIGS. 2, 3 and 4.

Figure 2:
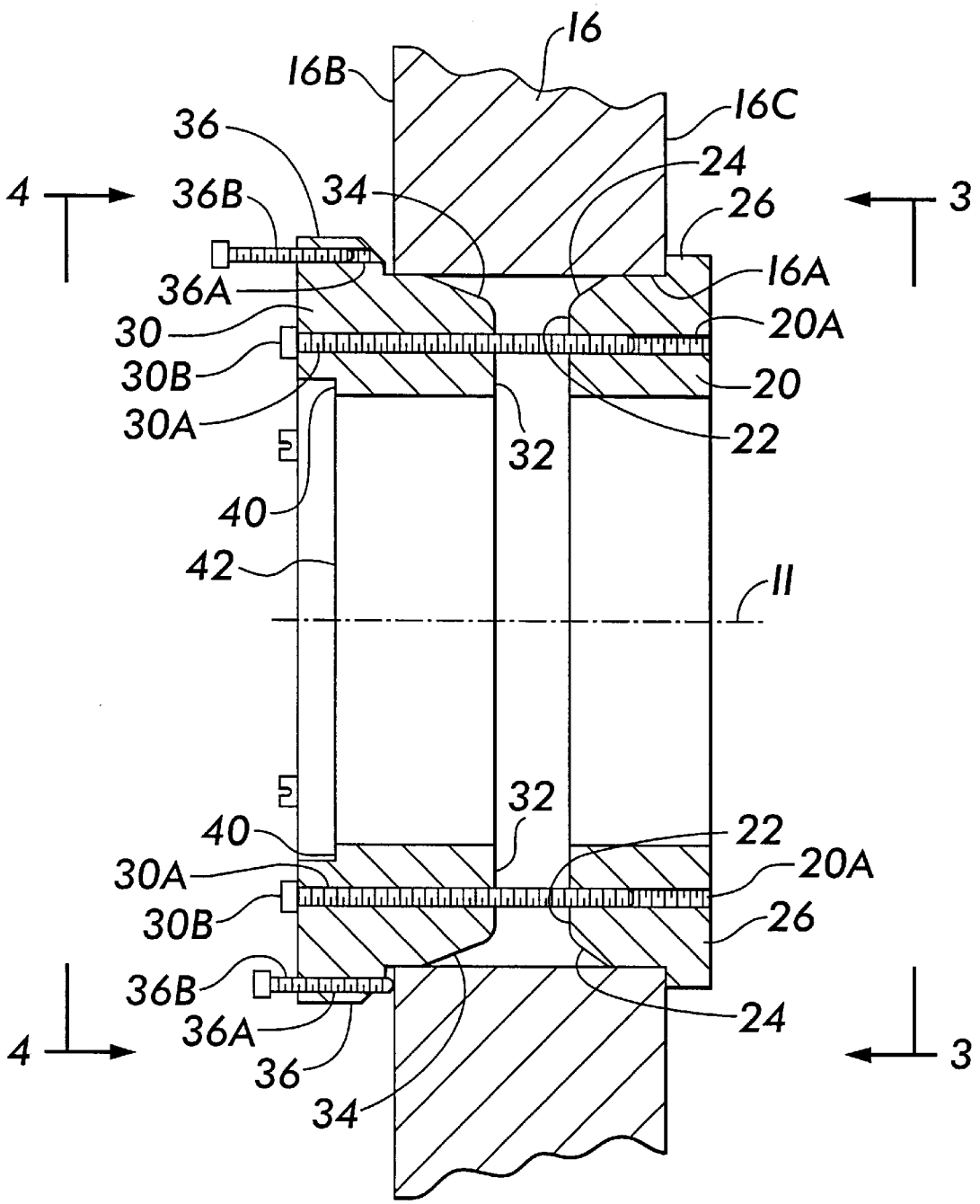
FIG. 2 is an enlarged cross-sectional view of the forward door having the boresight tool positioning system installed thereon.

In FIG. 2, an enlarged, isolated cross-sectional view of door 16 is shown with the boresight tool positioning system of the present invention installed. The face of door 16 facing away from launch cell 14 is indicated at 16B and the face of door 16 facing towards launch cell 14 is indicated at 16C. A first tube 20 is sized to precision tolerances to form a clearance-fit engagement in hole 16A from face 16C. The outer diameter of rigid tube 20 can be reduced at end 22 by means of a taper 24 in order to facilitate the insertion of tube 20 into hole 16A. Tube 20 incorporates a radially-extending flange(s) indicated at 26 which abuts face 16C. Screw holes 20A are provided in the main body of tube 20.

A second rigid tube 30 is sized to precision tolerances to form a clearance-fit engagement in hole 16A from opposing face 16B. The outer diameter of tube 30 can be reduced at end 32 by means of a taper 34 in order to facilitate the insertion of tube 30 into hole 16A. Tube 30 incorporates a radially-extending flange(s) indicated at 36 which can lie adjacent (or abut) face 16B. For reasons that will become more apparent below, tube 30 also has adjustment screw holes 36A provided in flange(s) 36 and coupling screw holes 30A provided in the main body of tube 30 for receiving threaded fasteners 36B and 30B, respectively. Tube 30 is further notched to define an annular shoulder 40, the center of which is aligned with the center of hole 16A, i.e., launch cell axis 11.

In operation, tube 20 and tube 30 are inserted into hole 16A from opposing sides thereof. Tube 20 is inserted into hole 16A until flange 26 abuts face 16C. Tube 30 can be inserted into hole 16A until flange 36 abuts face 16B. However, it is likely that door 16 is not completely flat. Therefore, in order to insure that tube 30 is "squared up" in hole 16A (i.e., a plane 42 defined by shoulder 40 is perpendicular to launch cell axis 11), threaded fasteners 36B can be turned to extend from flange(s) 36 and cooperate with face 16B as needed to "square up" plane 42. This capability is needed so that any boresight calibration tool coupled thereto will sight along launch cell axis 11. Once tube 30 is fixed in its square relationship, tube 30 can be fixedly coupled to tube 20. This is accomplished by turning threaded fasteners 30B until they mate with and are tightened in corresponding holes 20A.

With tubes 20 and 30 fixed in place as described, a boresight calibration tool can be mounted on tube 30. More specifically, since the center of plane 42 is aligned with launch cell axis 11, the center of plane 42 serves as a point of reference for any boresight calibration tool. For example, at the forward end of launch cell 14, a cross-hair is frequently used in boresight calibration measurements. In the present invention, the cross-hair would be supported on a disk-shaped support plate 50 such as shown in FIGS. 5A and 5B.

Support plate 50 has a plug portion 52 and flange portion 54. Plug portion 52 is sized to fit through annular shoulder 40 while flange portion 54 rests on shoulder 40. In terms of supporting calibration cross-hairs, plug portion 52 can be made of clear plastic or glass with cross-hairs 100 engraved therein. Alternatively, all of plate 50 could be made from clear plastic or glass. The cross-hairs intersection point 101 is at the center of plate 50 and will therefore be aligned with launch cell axis 11 once plate 50 is installed in tube 30.

Support plate 50 must be secured to tube 30. One way of accomplishing this is to provide securing screws 38 (FIG. 4) tube 30 just outside annular shoulder 40. The heads of screws 38 extend partially over shoulder 40. A plurality of cutouts 56 (four are shown) are provided about the periphery of plate 50. When cutouts 56 are aligned with screws 38, plate 50 can be removed. When cutouts 56 are misaligned with respect to screws 38, screws 38 are tightened such that their heads press against flange 54 thereby securing plate 50 to tube 30.

Other boresight calibration tools could also be coupled to tube 30 using the same approach. For example, if a boresight needed to sight forward of the launch cell, support plate 50 would retain its plug portion 52, flange portion 56 and cutouts 56. However, plug portion 52 would simply incorporate a mounting platform for a small, hand-held boresight such as the boresight used on the U.S. Navy's 20 millimeter gun. Thus, the present invention provides great versatility in that once tubes 20 and 30 are positioned, small hand-held boresight calibration tools can be quickly installed and removed for various calibration operations.

Figure 6:
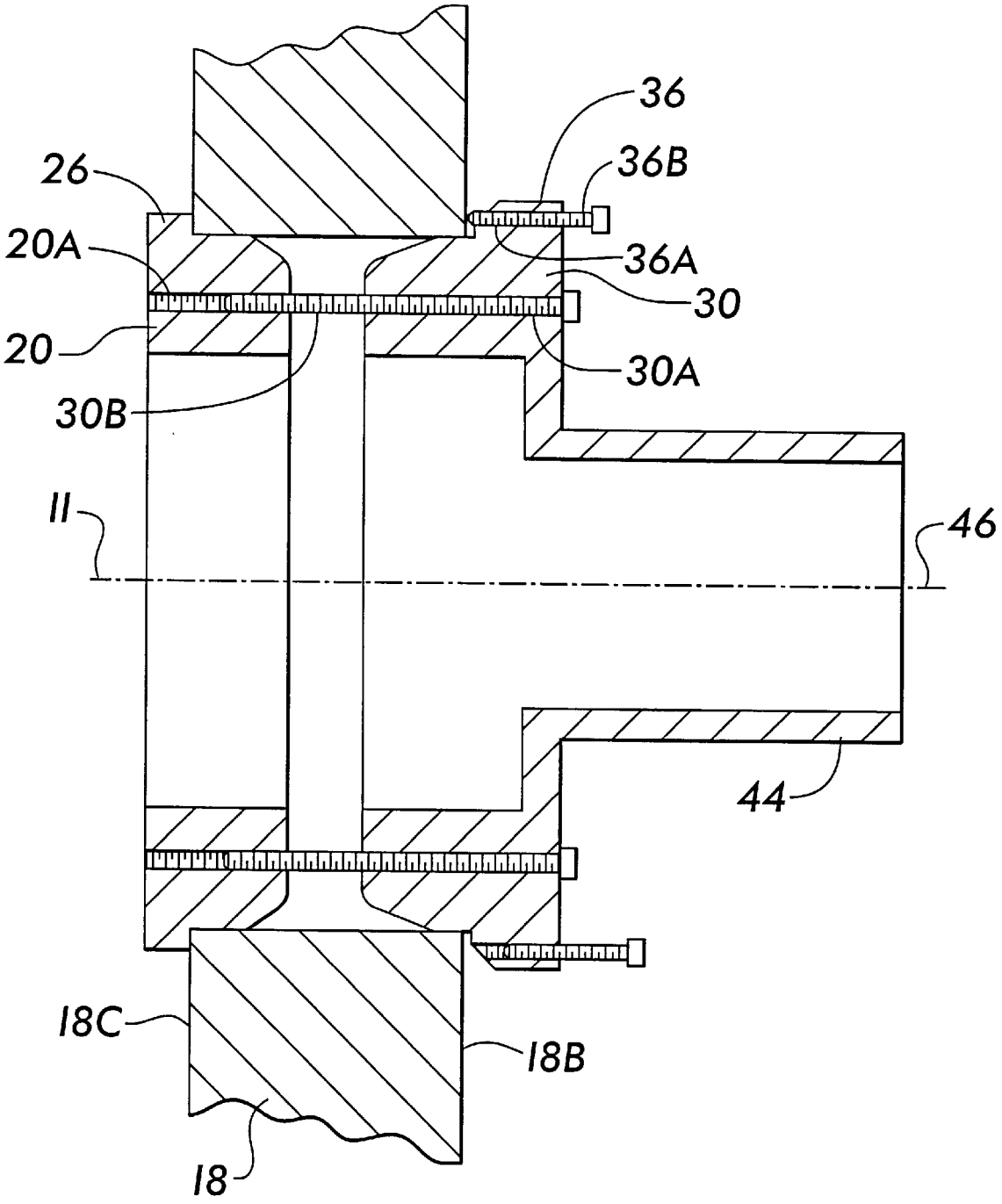
FIG. 6 is an enlarged cross-sectional view of the aft door having an alternative boresight tool positioning system installed thereon.

Aft door 18 can be similarly outfitted with a tube 20 and tube 30 arrangement as just described. The support plate 50 used at the aft end of launch cell 14 can be configured to incorporate a mounting platform for a hand-held boresight (not shown) that sights through launch cell 14. Alternatively, if the hand-held boresight is the only calibration tool that need be mounted at aft door 18, tube 30 can be configured to permanently integrate a boresight mounting platform as shown in FIG. 6. More specifically, tube 30 in FIG. 6 has tubular mounting platform 44 integrated therewith to provide a line-of-sight along launch cell axis 11. The particular shape of platform 44 will be dependent upon the boresight that will be attached. However, in general, the center axis 46 of platform 44 is located such that it is coincident with launch cell axis 11 when installed in aft door 18. This thus provides a reference point for any boresight attached to platform 44.

The advantages of the present invention are numerous. A simple system is provided for the positioning of hand-held boresight calibration tools at either end of a launch cell. This eliminates the need to use conventional large boresight tools that must be hoisted into a launch cell. Further, once positioned on a launch cell door, a variety of calibration tools can be quickly interchanged without re-positioning the entire system.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. In a launch cell capable of supporting a projectile therein such that a central longitudinal axis of said launch cell is coincident with a central longitudinal axis of said projectile, said launch cell terminating at either end thereof in a door where each door is provided with a hole through which said projectile can pass wherein a center of said hole is coincident with said central longitudinal axis of said launch cell, a system for positioning a boresight calibration tool relative to said central longitudinal axis of said launch cell, said system comprising:

an open-ended first tube sized for engagement in said hole, said first tube terminating at a first end thereof in a flange wherein said first tube is inserted into said hole from a side of said door facing towards said launch cell until said flange of said first tube abuts said door;

an open-ended second tube sized for engagement in said hole, said second tube terminating at a first end thereof in a flange wherein said second tube is inserted into said hole from a side of said door facing away from said launch cell such that said flange of said second tube is adjacent said door, and wherein said first tube and said second tube are spaced apart from one another within said hole;

said second tube including means for supporting a boresight calibration tool at said first end thereof;

means for coupling said first tube to said second tube when said first tube and said second tube are engaged in said hole; and means cooperating between said flange of said second tube and said door for adjusting spacing therebetween.

2. A system as in claim 1 wherein said first tube has a tapered outside diameter at a second end thereof opposite said first end thereof.

3. A system as in claim 1 wherein said second tube has a tapered outside diameter at a second end thereof opposite said first end thereof.

4. A system as in claim 1 wherein said means for coupling comprises a plurality of threaded fasteners passing through said second tube and into said first tube.

5. A system as in claim 1 wherein said means cooperating between said flange of said second tube and said door for adjusting spacing therebetween comprises a plurality of threaded fasteners passing through said flange of said second tube.

6. In a launch cell capable of supporting a projectile therein such that a central longitudinal axis of said launch cell is coincident with a central longitudinal axis of said projectile, said launch cell terminating at one end thereof in a forward door and at another end thereof in an aft door where said forward door and said aft door are provided with a hole through which said projectile can pass wherein a center of each said hole is coincident with said central longitudinal axis of said launch cell, a system for positioning boresight calibration tools relative to said central longitudinal axis of said launch cell, said system comprising:

an open-ended first tube sized for engagement in said hole of said forward door, said first tube terminating at one end thereof in a flange wherein said first tube is inserted into said hole of said forward door from a side of said forward door facing towards said launch cell until said flange of said first tube abuts said forward door;

an open-ended second tube sized for engagement in said hole of said forward door, said second tube terminating at one end thereof in a flange wherein said second tube is inserted into said hole of said forward door from a side of said forward door facing away from said launch cell such that said flange of said second tube is adjacent said forward door, and wherein said first tube and said second tube are spaced apart from one another within said hole of said forward door;

said second tube including means for supporting a boresight calibration tool at said one end thereof;

means for coupling said first tube to said second tube when said first tube and said second tube are engaged in said hole of said forward door;

means cooperating between said flange of said second tube and said door for adjusting spacing therebetween;

an open-ended third tube sized for engagement in said hole of said aft door, said third tube terminating at one end thereof in a flange wherein said third tube is inserted into said hole of said aft door from a side of said aft door facing towards said launch cell until said flange of said third tube abuts said aft door;

an open-ended fourth tube sized at one end thereof for engagement in said hole of said aft door, said fourth tube terminating at another end thereof in a mounting platform for a boresight configured to sight away from said launch cell, said fourth tube further having a flange between said one end and said another end thereof, wherein said one end of said fourth tube is inserted into said hole of said aft door from a side of said aft door facing away from said launch cell such that said flange of said fourth tube is adjacent said aft door, and wherein said third tube and said fourth tube are spaced apart from one another within said hole of said aft door;

means for coupling said third tube to said fourth tube when said third tube and said fourth tube are engaged in said hole of said aft door; and means cooperating between said flange of said fourth tube and said aft door for adjusting spacing therebetween.

7. A system as in claim 6 wherein said means for coupling said first tube to said second tube comprises a plurality of threaded fasteners passing through said second tube and into said first tube.

8. A system as in claim 7 wherein said plurality of threaded fasteners are distributed around said second tube.

9. A system as in claim 6 wherein said means for coupling said third tube to said fourth tube comprises a plurality of threaded fasteners passing through said fourth tube and into said third tube.

10. A system as in claim 9 wherein said plurality of threaded fasteners are distributed around said fourth tube.

11. A system as in claim 6 wherein said means cooperating between said flange of said second tube and said forward door for adjusting spacing therebetween comprises a plurality of threaded fasteners passing through said flange of said second tube.

12. A system as in claim 6 wherein said means cooperating between said flange of said fourth tube and said aft door for adjusting spacing therebetween comprises a plurality of threaded fasteners passing through said flange of said fourth tube.

13. A system as in claim 6 wherein said means for supporting a boresight calibration tool comprises:

said one end of said second tube being annularly notched to define an annular shoulder centered on said center of said hole of said forward door;

a disk-shaped support plate for supporting said boresight calibration tool at a central portion thereof, said support plate resting on said annular shoulder; and means for securing said support plate to said one end of said second tube.

* * * * *